US007311561B2

(12) United States Patent
Anbo et al.

(10) Patent No.: US 7,311,561 B2
(45) Date of Patent: Dec. 25, 2007

(54) CONNECTING TERMINAL

(75) Inventors: Tsugio Anbo, Tokyo (JP); Yukifumi Machida, Tokyo (JP)

(73) Assignee: Mitsubishi Cable Industries, Ltd., Tokyo (JP)

( * ) Notice: Subject to any disclaimer, the term of this patent is extended or adjusted under 35 U.S.C. 154(b) by 0 days.

(21) Appl. No.: 10/560,788

(22) PCT Filed: Jun. 17, 2004

(86) PCT No.: PCT/JP2004/008537

§ 371 (c)(1),
(2), (4) Date: Nov. 21, 2006

(87) PCT Pub. No.: WO2004/114467

PCT Pub. Date: Dec. 29, 2004

(65) Prior Publication Data

US 2007/0099520 A1 May 3, 2007

(30) Foreign Application Priority Data

Jun. 18, 2003 (JP) ..... 2003-173929

(51) Int. Cl.
*H01R 13/40* (2006.01)

(52) U.S. Cl. ..... 439/752.5

(58) Field of Classification Search ..... 439/752.5, 439/595

See application file for complete search history.

(56) References Cited

U.S. PATENT DOCUMENTS

| | | | | |
|---|---|---|---|---|
| 5,190,477 | A * | 3/1993 | Akeda | 439/595 |
| 5,556,304 | A * | 9/1996 | Jinno | 439/565 |
| 5,628,652 | A * | 5/1997 | Ohsumi | 439/595 |
| 6,338,638 | B2 * | 1/2002 | Kodama | 439/246 |

FOREIGN PATENT DOCUMENTS

| | | |
|---|---|---|
| JP | 100321/1989 | 4/1991 |
| JP | 125560/1990 | 7/1992 |
| JP | 7-263064 A | 10/1995 |
| JP | 2000-231956 A | 8/2000 |
| JP | 2002-170620 A | 6/2002 |

* cited by examiner

*Primary Examiner*—Phuong Dinh
(74) *Attorney, Agent, or Firm*—Frishauf, Holtz, Goodman & Chick, P.C.

(57) ABSTRACT

A connecting terminal has a rectangular tube-like connecting portion 11 including a bottom plate 13, a first side plate not shown, a top plate 15 and a second side plate 16. At a rear end of the top plate 15, there is formed a locking portion 19 by folding a rear end of the top plate inwardly. A stabilizer portion 17 provided at one side of the second side plate 16 is bent downwardly into a semicircular shape to extend downwardly with respect to the bottom plate.

7 Claims, 3 Drawing Sheets

CONNECTING TERMINAL

This application is a U.S. National Phase Application under 35 USC 371 of International Application PCT/JP2004/008537 filed Jun. 17, 2004.

TECHNICAL FIELD

The present invention relates to a female type connecting terminal for receiving a male type connecting terminal, said female type and male type connecting terminal constituting an electrical connector.

TECHNICAL BACKGROUND

A female type connecting terminal of the kind mentioned above is provided within a housing and is used to establish the electrical connection by receiving a cooperating male type connecting terminal. When the male type connecting terminal is inserted into the female type connecting terminal, the female type connecting terminal is pushed backwardly. In order to prevent the female type connecting terminal from being removed out of the housing, a connecting portion of the connecting terminal is engaged with a resilient locking lance provided in the housing.

In order to keep the connecting terminal 1 within the housing, a stabilizer portion 3 extending in a longitudinal direction is provided on an upper wall of a connecting portion 2 as illustrated in FIG. 7, said stabilizer portion 3 serving to prevent a swinging motion of the connecting terminal 1 within the housing. The stabilizer portion 3 also serves to prevent an erroneous insertion of the connecting terminal 1 into the housing, and the connecting terminal could not be inserted in an up side down fashion.

DISCLOSURE OF THE INVENTION

Problems to be Solved by the Invention

Recently electrical connectors having small size and a large number of connecting terminals have been required, and accordingly connecting terminals installed within housings have been also required to have small size. In order to insert the connecting terminal 1 into the housing through a locking lance, a width of the locking lancer has to be a width of the connecting portion 2 reduced by a width of the stabilizer portion 3. Therefore, a width of the locking lancer should be very small and could not generate a sufficiently large force for locking the connecting terminal.

The present invention has for its object to provide a connecting terminal, which can remove the above mentioned problems and a width of the locking lance is not effected by the stabilizer portion.

MEANS FOR SOLVING THE PROBLEMS

According to the invention, a connecting terminal including a connecting portion formed in a rectangular tube having a top plate to which a locking lancer provided in a housing is to be engaged, characterized in that a stabilizer portion for stabilizing a posture of the connecting terminal within the housing is provided on a bottom plate of said connecting portion to extend in a longitudinal direction.

MERITS OF THE INVENTION

In the connecting terminal according to the invention, since the stabilizer portion is provided on the bottom wall of the connecting portion, a width of the locking lance provided on the housing for preventing a withdrawal of the connecting terminal backwardly can be set to be substantially identical with a width of the connecting portion without considering a width of the stabilizer portion, and therefore the connecting terminal can be prevented effectively with a rather large force from being removed from the housing.

Figure 1:
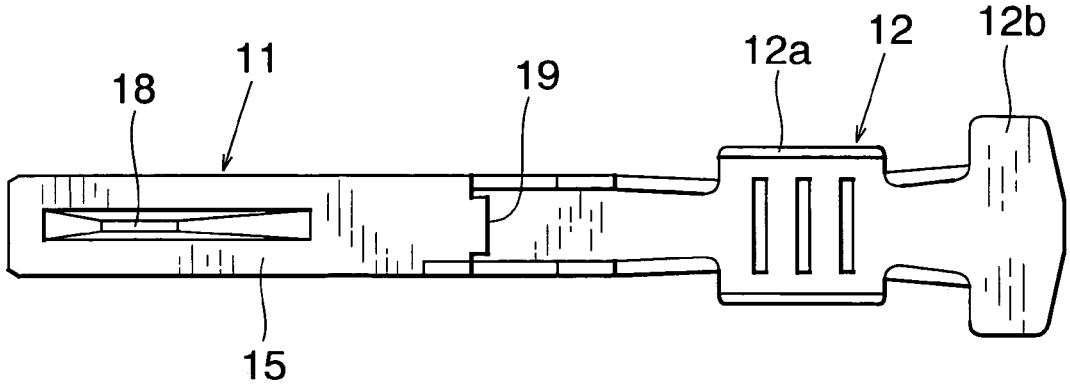
FIG. 1 is a plan view showing an embodiment of the connecting terminal according to the invention.

| Explanation of Reference Numerals | |
|---|---|
| 11 | connecting portion |
| 12 | wire clamping portion |
| 13 | bottom plate |
| 14, 16 | side plate |
| 15 | top plate |
| 17 | stabilizer portion |
| 19 | locking portion |
| 21 | movable contact strip |
| 32 | housing |
| 33 | locking lance |

BEST MODE OF THE INVENTION

Figure 2:
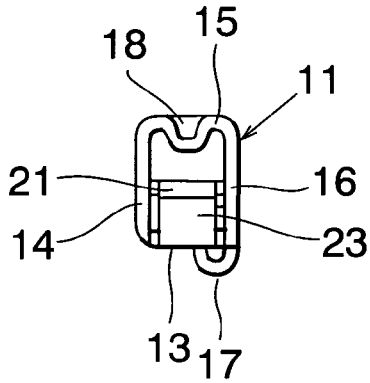
FIG. 2 is a front view of the connecting terminal.
Figure 3:
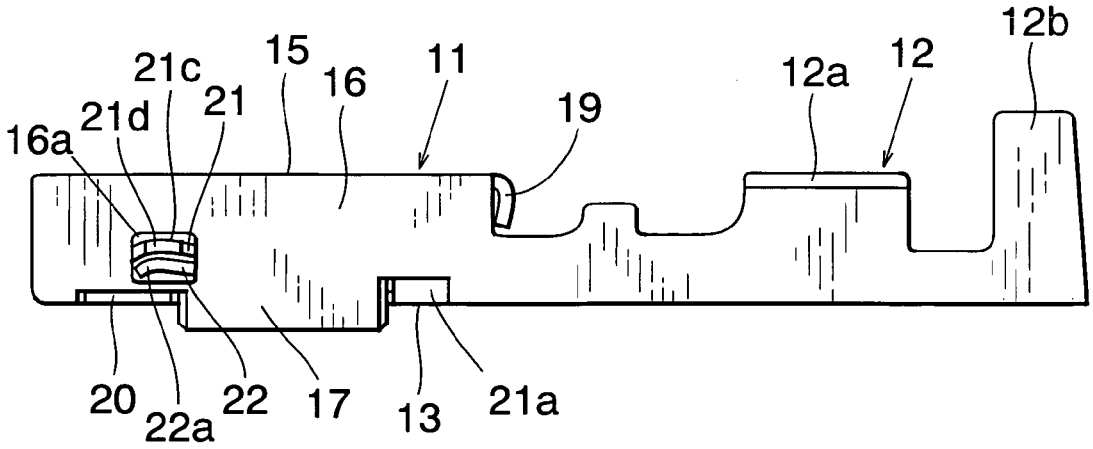
FIG. 3 is a side view of the connecting terminal.
Figure 4:
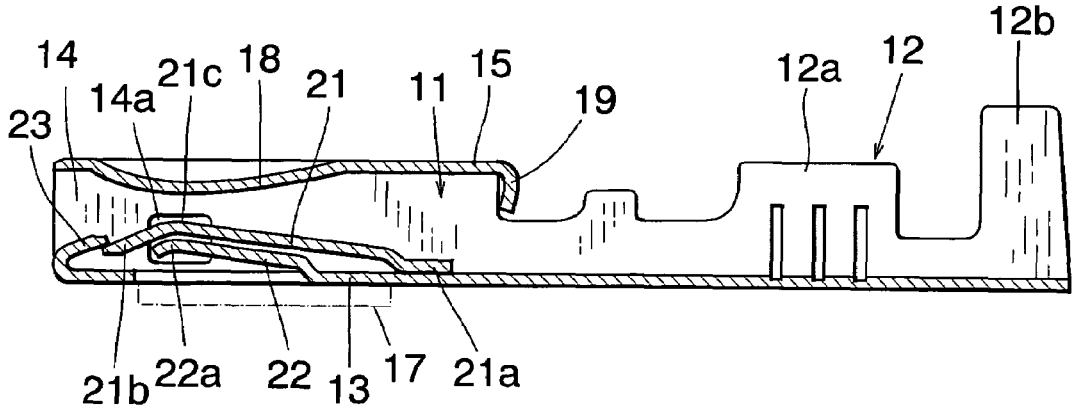
FIG. 4 is a cross sectional view of the connecting terminal.
Figure 5:
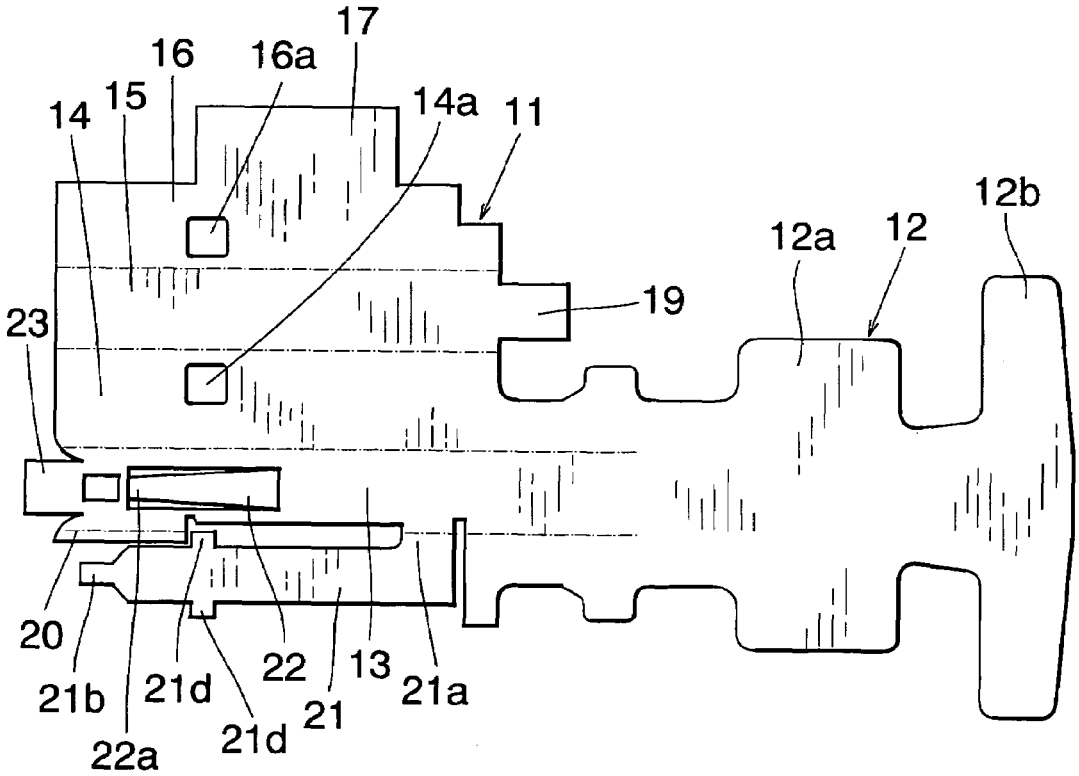
FIG. 5 is an exploded view showing the connecting terminal before assembling.

FIG. 1 is a plan view, FIG. 2 is a front view, FIG. 3 is a side view, FIG. 4 is a cross sectional view, and FIG. 5 is exploded plan view before assembling showing an embodiment of connecting terminal according to the invention. The connecting terminal is formed by punching a single metal plate into a given shape, and then folding and bending various portions. Generally speaking, the connecting terminal comprises a rectangular tube-like connecting portion 11 provided at a front side and a wire clamping portion 12 provided at a rear side. As usual, the wire clamping portion 12 includes a core conductor clamping portion 12*a* and a sheath clamping portion 12*b*, these clamping portions being formed into a U-shape.

The connecting portion 11 comprises a bottom plate 13, a first side plate 14 connected to one side of the bottom plate, a top plate 15, a second side plate 16 and a stabilizer portion 17, which are successively coupled with each other in this order. The bottom plate 13, first sided plate 14, top plate 15 and second side plate 16 are folded to constitute a rectangular tube. In the top plate 15 there is formed a recessed portion 18 which extends in a longitudinal direction and is bend inwardly. At a rear end of the top plate 15 there is further formed a locking portion 19, which is bent inwardly to be engaged with a locking lance provided on a housing.

The stabilizer portion 17 formed at a side of the second side plate 16 is bent to have a semicircular cross section in such a manner that the stabilizer portion 17 protrudes downward from the bottom plate 13 at a side of the second side plate 16 and a free end of the stabilizer portion 17 is brought into contact with the lower surface of the bottom plate 13. That is to say, the stabilizer portion 17 is provided on the one side of the bottom plate 13 eccentrically to prevent the bottom plate 13 from being pushed downward. There is further provided a closing portion 20 for closing the connecting portion 11.

On the other side of the bottom plate 13 there is formed a movable contact strip 21 to extend in parallel with the bottom plate 13. The movable contact strip 21 is secured to the rear portion of the bottom plate 13 at a base portion 21*a*. Prior to the formation of the connecting portion 11, the movable contact strip 21 is folded at the base portion 21*a* over the bottom plate 13 and is bent in such a manner that a portion of the movable contact strip 21 between the base portion 21*a* and a free front end 21*b* is bent upward into a shape of mountain. On both sides of the movable contact strip 21 there are formed wing portions 21*d*. These wing portions 21*d* are inserted movably into holes 14*a* and 16*a* formed in the first and second side plates 14 and 16, respectively upon constructing the connecting portion 11.

In the bottom plate 13 there is further formed an elongated reinforcing strip 21 by cutting such that a rear end of the reinforcing strip 22 is connected to the bottom plate 13. The reinforcing strip 22 is folded inwardly such that a front end 22*a* is brought into contact with a lower surface of a contact portion 21*c* of the movable contact strip 21.

At the front end of the connecting portion 11, there is provided a guide strip 23, which is formed by folding a front portion of the bottom plate 13 inwardly. The guide strip 23 covers the free front end 21*b* of the movable contact strip 21 to prevent a forward movement of the free front end and to guide the insertion of the corresponding male type connecting terminal.

In the connecting terminal according to the invention having the above explained structure, the contact portion 21*c* of the movable contact strip 21 can be provided at a relatively front position within the connecting portion 11, and furthermore since the free end 21*b* of the movable contact strip 21 is constructed by the front end, a resilient force of the movable contact strip 21 is relatively small and a necessary force for inserting the corresponding male type connecting terminal can be reduced.

Figure 6:
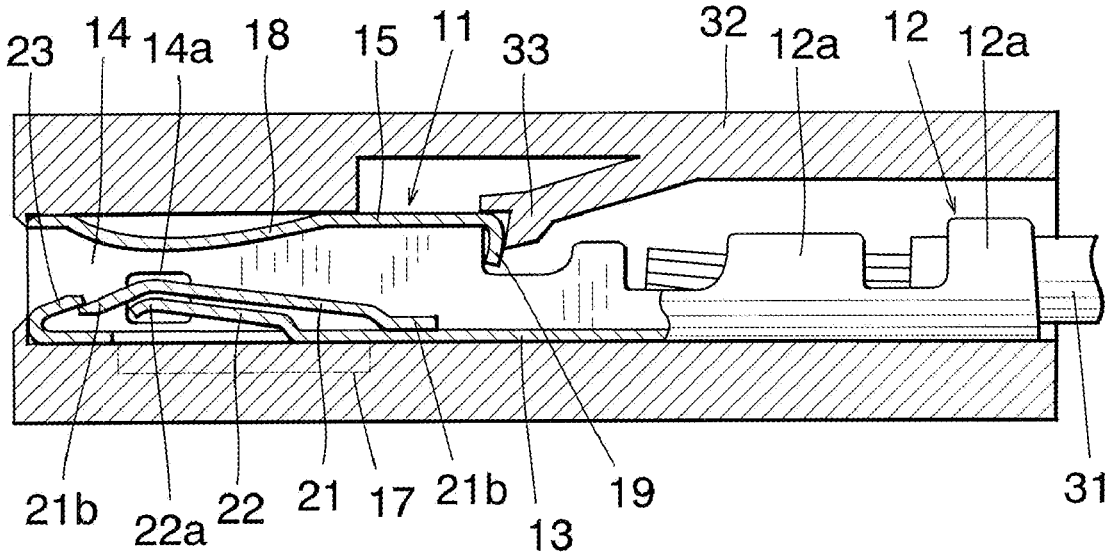
FIG. 6 is a cross sectional view illustrating the connecting terminal installed within the housing.
Figure 7:
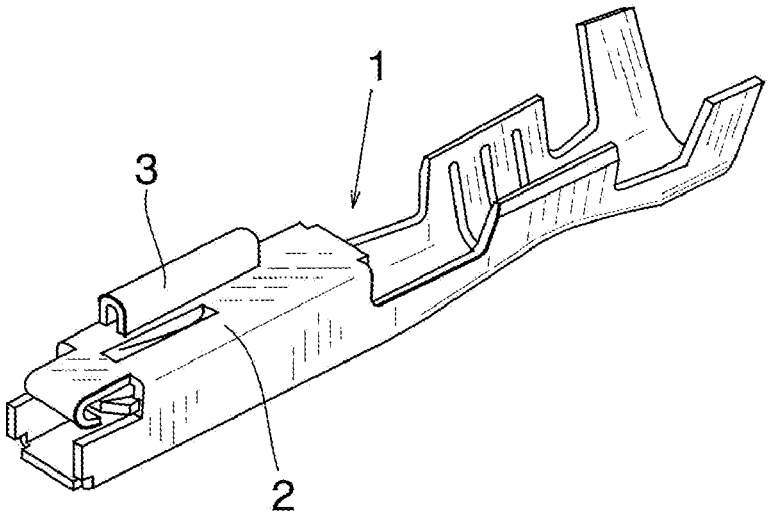
Fig.7 PRIOR ART
FIG. 7 is a perspective view showing a known connecting terminal.

FIG. 6 is a cross sectional view showing a condition in which an electrical wire 31 is connected to the wire clamping portion 12 and the connecting terminal is inserted into the housing 32. The stabilizer portion 17 is clamped into a recess formed in the housing 32, and therefore a posture of the connecting terminal within the housing 32 can be stabilized. Furthermore, an erroneous insertion of the connecting terminal can be effectively prevented, because the connecting terminal could not be inserted in an up side down fashion.

When the connecting portion 11 is inserted into the housing 32, the resilient locking lance 33 is pushed upward and the connecting portion 11 passes under the locking lance 33. In this case, since the stabilizer portion 17 is formed under the connecting terminal, a width of the locking lance 33 can be determined without considering the stabilizer portion 17 and can be set to a large value substantially equal to a width of the connecting portion 11. Therefore, a large locking force due to the engagement of the locking lance 33 with the locking portion 19 can be attained.

What is claimed is:

1. A connecting terminal comprising:

a connecting portion formed in a rectangular tube having a top plate to which a locking lancer provided in a housing is engaged when the connecting terminal is arranged in the housing, and a stabilizer portion for stabilizing a posture of the connecting terminal within the housing provided on a bottom plate of said connecting portion to extend in a longitudinal direction and engaging with a recess provided at a bottom portion of the housing when the connecting terminal is arranged in the housing, wherein said stabilizer portion is curved downwardly in a semicircular shape from one portion of said bottom plate such that a free end of said stabilizer portion is brought into contact with another portion of said bottom plate.

2. The connecting terminal according to claim 1, wherein said connecting terminal is formed by punching, bending and folding a single metal plate.

3. The connecting terminal according to claim 1, wherein said stabilizer is formed on the bottom plate eccentrically.

4. The connecting terminal according to claim 1, wherein said connecting portion of the connecting terminal is formed in a shape of the rectangular tube defined by the bottom plate, the top plate, a first side plate connected to one side of the bottom plate and to the top plate, a second side plate connected to the top plate, and the stabilizer portion connected to the second side plate.

5. The connecting terminal according to claim 1, wherein said connecting portion includes resilient contact strips formed within the connecting portion, and each of said movable contact strips is formed by a part of the connecting portion from a rear side toward a front side.

6. The connecting terminal according to claim 2, wherein said connecting portion of the connecting terminal is formed in a shape of the rectangular tube defined by the bottom plate, the top plate, a first side plate connected to one side of the bottom plate and to the top plate, a second side plate connected to the top plate, and the stabilizer portion connected to the second side plate.

7. The connecting terminal according to claim 3, wherein said connecting portion of the connecting terminal is formed in a shape of the rectangular tube defined by the bottom plate, the top plate, a first side plate connected to one side of the bottom plate and to the top plate, a second side plate connected to the top plate, and the stabilizer portion connected to the second side plate.

* * * * *